US012188462B2

(12) United States Patent
Voser

(10) Patent No.: US 12,188,462 B2
(45) Date of Patent: Jan. 7, 2025

(54) PACKING SEAL FOR A PISTON COMPRESSOR AND METHOD FOR OPERATING SAME

(71) Applicant: BURCKHARDT COMPRESSION AG, Winterthur (CH)

(72) Inventor: Alexandre Voser, Elsau (CH)

(73) Assignee: BURCKHARDT COMPRESSION AG, Winterthur (CH)

( * ) Notice: Subject to any disclaimer, the term of this patent is extended or adjusted under 35 U.S.C. 154(b) by 273 days.

(21) Appl. No.: 17/770,832

(22) PCT Filed: Oct. 21, 2020

(86) PCT No.: PCT/EP2020/079673
§ 371 (c)(1),
(2) Date: Apr. 21, 2022

(87) PCT Pub. No.: WO2021/078820
PCT Pub. Date: Apr. 29, 2021

(65) Prior Publication Data

US 2022/0372962 A1 Nov. 24, 2022

(30) Foreign Application Priority Data

Oct. 21, 2019 (EP) ..... 19204408

(51) Int. Cl.
*F04B 39/04* (2006.01)
*F04B 9/04* (2006.01)
(Continued)

(52) U.S. Cl.
CPC ..... *F04B 39/041* (2013.01); *F04B 9/045* (2013.01); *F04B 35/01* (2013.01);
(Continued)

(58) Field of Classification Search
CPC ..... F04B 39/041; F04B 9/045; F04B 35/01; F04B 39/0022; F04B 39/042;
(Continued)

(56) References Cited

U.S. PATENT DOCUMENTS 1,526,909 A 2/1925 Hiller
3,731,984 A * 5/1973 Habermann ..... F16C 32/0476 310/90.5
4,141,604 A * 2/1979 Habermann ..... F16C 32/0402 310/90.5
4,889,039 A * 12/1989 Miller ..... F04B 39/045 92/162 R
(Continued)

FOREIGN PATENT DOCUMENTS

CN 103994051 A 8/2014
DE 3805670 A1 9/1989
JP 1244178 9/1989

OTHER PUBLICATIONS

International Search Report for PCT/EP2020/079673, Prepared by the European Patent Office, mailing date Dec. 11, 2020, 11 pages including English Translation.

*Primary Examiner* — Dominick L Plakkoottam
(74) *Attorney, Agent, or Firm* — Brooks Kushman P.C.

(57) ABSTRACT

The packing seal for a piston compressor, having a longitudinal axis L as well as, following one after the other in the direction of the longitudinal axis L, a fastening part and a cylindrical part, wherein a magnetic bearing and at least one chamber ring with a sealing ring arranged therein are arranged following one after the other in the direction of the longitudinal axis L in the cylindrical part, wherein the magnetic bearing includes at least one controllable electromagnet.

15 Claims, 4 Drawing Sheets

(51) Int. Cl.

| | |
|---|---|
| ***F04B 35/01*** | (2006.01) |
| ***F04B 39/00*** | (2006.01) |
| ***F04B 39/12*** | (2006.01) |
| ***F04B 49/06*** | (2006.01) |
| ***F04B 53/08*** | (2006.01) |

(52) U.S. Cl.
CPC ..... *F04B 39/0022* (2013.01); *F04B 39/042* (2013.01); *F04B 39/122* (2013.01); *F04B 49/06* (2013.01); *F04B 53/08* (2013.01)

(58) Field of Classification Search
CPC ..... F04B 39/122; F04B 49/06; F04B 53/08; F04B 39/0005; F04B 39/121; F04B 39/12; F05B 2240/57; F05B 2240/515
See application file for complete search history.

(56) References Cited

U.S. PATENT DOCUMENTS

| | | | | |
|---|---|---|---|---|
| 5,736,800 | A * | 4/1998 | Iannello | F16C 32/048 310/90 |
| 5,818,131 | A * | 10/1998 | Zhang | F04D 13/0646 310/90.5 |
| 7,815,193 | B2 | 10/2010 | Feistel et al. | |
| 9,515,589 | B2 * | 12/2016 | Kozaki | H02P 6/185 |
| 10,247,183 | B2 | 4/2019 | Koop et al. | |
| 2006/0175920 | A1 * | 8/2006 | Shimada | B23Q 1/70 310/90.5 |
| 2014/0356196 | A1 * | 12/2014 | Moore | F04B 49/103 417/266 |
| 2021/0115930 | A1 * | 4/2021 | Dozzini | F04D 25/0686 |

* cited by examiner

PACKING SEAL FOR A PISTON COMPRESSOR AND METHOD FOR OPERATING SAME

CROSS-REFERENCE TO RELATED APPLICATION

This application is the U.S. national phase of PCT Application No. PCT/EP2020/079673 filed on Oct. 21, 2020, which claims priority to EP patent application Ser. No. 19/204,408.9 filed on Oct. 21, 2019, the disclosures of which are incorporated in their entirety by reference herein.

The invention relates to a packing seal for a piston compressor and a method of operating the same.

STATE OF THE ART

Document U.S. Pat. No. 1,526,909 discloses a piston compressor with a packing seal. This piston compressor is subject to relatively large wear, the piston compressor can only be operated at relatively low rotational speed, and replacement of the packing seal is relatively complex. Document WO2014/139565A1 discloses a piston compressor with a horizontally extending cylinder in which a piston is arranged that can move back and forth in the horizontal direction. This piston compressor has the disadvantage that the guide rings and/or sealing rings arranged on the piston are subject to relatively large wear, and that the piston compressor can only be operated at relatively low rotational speed. The document DE3805670A1 discloses a piston compressor with a vertically extending cylinder, wherein the piston can be designed as a labyrinth piston or as a piston provided with captured piston rings. This piston compressor also has the disadvantage that wear can occur.

DESCRIPTION OF THE INVENTION

The problem of the invention is to provide a more advantageous packing seal for a piston compressor and a more advantageous operating method of a piston compressor comprising the packing seal.

Preferably, the piston compressor comprises a piston and a piston rod arranged to be movable in a horizontal direction or in a vertical direction.

This problem is solved with a packing seal for a piston compressor having the features of claim 1. The dependent device claims concern further advantageous embodiments. The problem is further solved with a method having the features of claim 13. The dependent method claims concern further advantageous method steps.

The problem is solved in particular with a packing seal for a piston compressor, wherein the packing seal comprises a longitudinal axis as well as, following one after the other in the direction of the longitudinal axis, a flange-shaped fastening part and a cylindrical part, wherein a magnetic bearing and at least one chamber ring with a sealing ring arranged therein are arranged following one after the other in the direction of the longitudinal axis in the cylindrical part, wherein the magnetic bearing comprises at least one controllable electromagnet.

The problem is further solved with a method for operating a piston compressor comprising a piston which is moved back and forth in the direction of a longitudinal axis within a cylinder, wherein the piston is driven via a piston rod, wherein the piston compressor comprises a packing seal with a controllable magnetic bearing and at least one chamber ring with a sealing ring arranged therein, wherein the piston rod extends through the packing seal, and wherein a controllable magnetic force acting at least perpendicularly to the longitudinal axis is exerted on the piston rod via the controllable magnetic bearing.

Preferably, the packing seal is arranged in a piston compressor for compressing a gas, comprising a cylinder, a piston, a piston rod, the packing seal, a crosshead, a magnetic bearing, and a drive, wherein the piston is arranged movably in a longitudinal direction within the cylinder, wherein the piston is connected to the crosshead via the piston rod, wherein between the piston and the crosshead the packing seal is arranged through which the piston rod passes, the crosshead being driven by the drive, the magnetic bearing being arranged between the piston and the crosshead, and the magnetic bearing being capable of exerting a magnetic force on the piston rod at least perpendicularly to the longitudinal direction, a sensor being arranged for detecting a state variable of the piston compressor, the magnetic bearing being designed as a controllable magnetic bearing, and a control device controlling the magnetic force exerted by the magnetic bearing on the piston rod depending on the state variable. Particularly preferred, the cylinder extends substantially in the horizontal direction.

Preferably, the packing seal is arranged in a piston compressor for compressing a gas, comprising a cylinder extending substantially in a horizontal direction and comprising a piston, a piston rod, the packing seal, a crosshead and a drive, wherein the piston is arranged movably in a longitudinal direction within the cylinder, wherein the piston is connected to the crosshead via a piston rod, wherein between the piston and the crosshead a packing seal is arranged through which packing seal the piston rod extends, and wherein the crosshead is driven by the drive, wherein a controllable magnetic bearing is also arranged between the piston and the crosshead, wherein the magnetic bearing can exert a magnetic force on the piston rod at least perpendicularly to the longitudinal direction, and wherein a control device controls the magnetic force exerted by the magnetic bearing on the piston rod.

Preferably, the packing seal is used in a method for operating a piston compressor, wherein the piston compressor comprises a piston which is moved back and forth in a longitudinal direction within a cylinder, wherein the piston is driven via a piston rod, and wherein a magnetic force acting at least perpendicularly to the longitudinal direction is exerted on the piston rod, wherein a state variable of the piston compressor is detected, wherein the magnetic force is controlled depending on the state variable, and wherein a magnetic force, preferably a relief force, is thereby exerted via the piston rod on the piston. Particularly preferably, the longitudinal direction extends essentially in a horizontal direction.

Preferably, the packing seal is used in a method for operating a piston compressor, wherein the piston compressor comprises a piston which is moved back and forth in a longitudinal direction within a cylinder, the longitudinal direction extending substantially in a horizontal direction, wherein the piston is driven via a piston rod, wherein a controllable magnetic force acting at least perpendicularly to the longitudinal direction is exerted on the piston rod and thereby a relief force is effected on the piston via the piston rod, wherein the magnetic force is controlled depending on a state variable.

The packing seal according to the invention for a piston compressor comprises a controllable magnetic bearing which is arranged between a piston and a crosshead of the piston compressor, wherein a piston rod connects the piston to the crosshead, wherein the piston rod extends through the magnetic bearing, and wherein the magnetic bearing exerts a controllable magnetic attractive force on the piston rod at least perpendicularly to the direction of extension of the piston rod. The packing seal according to the invention also preferably comprises at least one sensor which can be connected to a control device, wherein the control device is designed to supply electromagnets arranged in the controllable magnetic bearing with electric current or electric power, wherein the control device modulates or changes the supplied current or the supplied power depending on the value measured by the sensor in order to influence the position of the piston with respect to the cylinder, so that the piston at least temporarily has an advantageous position within the cylinder. The controllable magnetic bearing is preferably designed as a radial bearing, comprising a plurality of electromagnets arranged distributed in the circumferential direction and controllable by the control device. However, the magnetic bearing could also be designed in such a way that the magnetic force only acts in one direction or in one dimension, for example by arranging two controllable electromagnets opposite each other or symmetrically with respect to the piston rod, so that a magnetic force exerted by these electromagnets on the piston rod only acts in one dimension.

The piston compressor comprises at least one cylinder as well as a piston arranged so as to be movable back and forth within the cylinder, wherein the interior of the cylinder and thus also the movement of the piston in a preferred embodiment extends in the horizontal direction or substantially in the horizontal direction, such a piston compressor also being referred to as a horizontal piston compressor. As used herein, piston compressor preferably means a reciprocating compressor. The magnetic bearing exerts a controllable magnetic attraction force on the piston rod at least perpendicular to the direction of extension of the piston rod, and thus preferably exerts a vertically upwardly directed force on the piston rod, preferably in a direction opposite to the force of gravity.

In a preferred embodiment, the piston, which is movable in the horizontal direction, comprises a so-called guide ring, which rests on the inner surface of the cylinder. The attractive force exerted by the magnetic bearing on the piston rod at least in the vertical direction and/or the repulsive force exerted on the piston rod has the effect that the contact force of a piston supported on the inner surface of the cylinder is reduced, or that the piston or the guide ring no longer contacts the inner surface of the cylinder, so that the piston or the guide ring of the piston either rests only with reduced contact force on the inner surface of the cylinder, and particularly preferred moves back and forth within the cylinder without contacting the inner surface of the cylinder. If a piston has a guide ring, the use of the magnetic bearing results in the advantage that the contact force of the guide ring on the inner surface and thus the wear of the guide ring is reduced, so that the guide ring has a longer service life or a longer life cycle until it has to be replaced. In addition, there is the advantage that the piston compressor can, if desired, be operated at a higher rotational speed, wherein preferably no increased wear or heating occurs.

Particularly preferred, the packing seal according to the invention is used in combination with a piston which is designed as a labyrinth piston, such a labyrinth piston having, as is known per se, a labyrinth structure on its surface which serves to seal between the piston and the inner surface of the cylinder. The attraction force exerted by the magnetic bearing on the piston rod is preferably controlled in such a way that the piston moving back and forth does not touch the inner surface of the cylinder along the entire stroke path, the magnetic bearing preferably endeavoring to hold the piston in a central position with respect to the interior of the cylinder. However, the packing seal according to the invention is also suitable for piston compressors comprising pistons with piston rings and, if necessary, additionally comprising guide rings. The piston compressor described herein may, for example, only have a single piston with piston rod and cylinder, or preferably a plurality of pistons, piston rods and cylinders, in which case preferably each piston rod passes through a respective packing seal according to the invention.

In a further, preferred embodiment, the interior of the cylinder and thus also the movement of the piston extends in a vertical direction or essentially in a vertical direction. The magnetic bearing exerts a controllable magnetic attraction force on the piston rod at least perpendicular to the direction of extension of the piston rod, and thus exerts a force on the piston rod and the piston extending radially or substantially radially to the piston rod. The attraction force exerted by the magnetic bearing on the piston rod at least in the radial direction and/or the repulsion force exerted on the piston rod has the effect of reducing the contact force of a piston ring bearing against the inner surface of the cylinder, and in particular a one-sided contact force, or that the piston or its piston ring, and in particular a piston designed as a labyrinth piston, no longer contacts the inner surface of the cylinder, so that the piston or the piston ring either rests only with reduced contact force on the inner surface of the cylinder, and particularly preferred the labyrinth piston moves back and forth within the cylinder without contacting the inner surface of the cylinder. The use of the magnetic bearing results in the advantage that wear of the piston ring is reduced, so that the piston compressor has a longer service life or a longer life cycle until it requires maintenance. There is also the option of operating the piston compressor at a higher rotational speed. If the piston compressor comprises a labyrinth piston, the use of the magnetic bearing has the advantage that contact between the labyrinth piston and the inner surface of the cylinder can be avoided even better, since any optional eccentric arrangement of the labyrinth piston relative to the interior of the cylinder can be at least partially corrected with the aid of the magnetic bearing, and the piston is preferably centered in the interior of the cylinder relative to its longitudinal axis, so that no mutual contact occurs. The use of the magnetic bearing results in the additional advantage that the piston compressor can be operated safely even with a reduced gap width between the outer surface of the labyrinth piston and the inner surface of the cylinder, without any occurrence of mutual contact. This reduced gap width increases the efficiency of the piston compressor or reduces the loss during compression.

In a further preferred embodiment, the piston compressor comprises at least one piston and one cylinder, and preferably a plurality of pistons and cylinders, which are preferably arranged on a common frame, and which are preferably driven by a common crankshaft. In a preferred embodiment, such a piston compressor is arranged on a ship, wherein under calm sea conditions the cylinder, the interior of the cylinder and thus also the movement of the piston are in a vertical direction or substantially in a vertical direction. A turbulent or stormy sea results in the ship performing an increasing rolling or pitching motion as the wave height increases, with the result that the entire piston compressor and thus in particular also the longitudinal direction of the piston rod has an extension which depending on the wave action is variable as a function of time and deviates from the vertical by an angle beta. In a preferred embodiment, the angle Beta, and preferably the angle Beta as a function of time, is measured as an additional state variable.

On a ship, a multistage piston compressor is used, for example, to compress exhaust gas accumulating in a liquefied gas container to a pressure of 200 to 500 bar, in order to use the compressed gas to supply a gas engine or a diesel engine of the ship with fuel. A piston compressor arranged on a ship is preferably operated in such a way that the force exerted by the magnetic bearing at least in the radial direction on the piston rod is controlled as a function of the state variable and the additional state variable in such a way that the contact force of a piston ring bearing against the inner surface of the cylinder, and in particular a one-sided contact force, is reduced, or that the piston or its piston ring, and in particular a piston designed as a labyrinth piston, no longer touches the inner surface of the cylinder, so that on a ship, even under wave action, it is ensured that the piston or piston rings of the piston compressor either rests only with reduced contact force against the inner surface of the cylinder, and particularly preferred the labyrinth piston or pistons move back and forth within the cylinder without touching the inner surface of the cylinder. The use of the magnetic bearing results in the advantage that wear of the piston ring is reduced even under wave action, or that contact of the labyrinth structure of the labyrinth piston with the inner surface of the cylinder is avoided, in particular also in the case of a small gap width between the outer diameter of the piston and the inner surface of the cylinder, so that a piston compressor arranged on a ship has a longer service life or a longer life cycle until it requires maintenance. The magnetic bearing is preferably controlled in such a way that the magnetic bearing exerts a damping effect on the piston rod radially to the longitudinal axis of the piston rod in order to damp a movement of the piston rod and the piston in a direction radial to the longitudinal axis, for example to reduce the maximum amplitude of occurring resonance vibrations or other transverse vibrations of the piston, for example caused by wave action.

Since the motion of the waves or the measured and thus derived additional state is a relatively slow process compared to the rotational speed of the piston compressor, and the period of a wave motion of the water is slow by a factor of 10 to 1000 compared to the period of a revolution of the piston compressor, it is possible to pre-calculate a short-term change in the additional state variable, and to let this value flow into the control of the magnetic bearing by controlling the magnetic bearing with a predictive control which predicts the movement of the piston compressor to be expected on the basis of the wave motion, for example for a point in time which can lie, for example, in the range between 1 and 50 seconds, and controls the magnetic bearing accordingly, so that when influencing or controlling the position of the piston rod or the piston, the magnetic bearing is controlled in such a way that the expected movement of the piston compressor caused by the wave action is taken into account.

The packing seal according to the invention in combination with the piston compressor also has the advantage that it can be operated with a higher rotational speed or with a higher average piston speed, since the piston or the guide ring either no longer touches the inner wall of the cylinder at all or only rests against the inner wall of the cylinder with reduced contact force. Such operation with a higher number of revolutions is particularly advantageous for a piston compressor with a so-called dry-running piston, i.e. a labyrinth piston, or a piston with self-lubricating sealing rings, i.e. a piston whose piston rings or sealing rings are not oil-lubricated, which is also referred to as an unlubricated piston. The controllable magnetic bearing can be used either as a supporting bearing, by which the piston is held without contacting the inner surface of the cylinder, or it can be used as a relief bearing, by which the force exerted by the piston on the inner surface of the cylinder is reduced, in which case the piston contacts the inner wall. The controllable magnetic bearing can also perform a centering function on a substantially vertically extending piston, by which the piston is held centered, and preferably without contacting the inner surface of the cylinder.

In one embodiment, the magnetic bearing is arranged at a predetermined position in the horizontal piston compressor, whereas the position of the center of gravity of the piston changes constantly during operation due to backward and forward movement, so that the length of the lever arm formed by the piston rod between the magnetic bearing and the center of gravity of the piston changes constantly during operation. A control device provided for supplying power to the magnetic bearing is therefore preferably designed in such a way that the magnetic force exerted by the magnetic bearing on the piston rod is controllably modified depending on the position of the piston or depending on the length of the aforementioned lever arm. Preferably, at least one force acting in the vertical direction is exerted on the piston rod. Particularly preferred, the magnetic bearing is designed as a radial bearing which, perpendicular to the longitudinal direction of the piston rod, can exert a force on the piston rod which can be controlled in two dimensions, preferably a force in the vertical direction and a force in the horizontal direction. Advantageously, such a radial bearing is controlled in such a way that the piston does not touch the inner surface of the cylinder during operation in any of its possible positions, neither a lower nor an upper nor a lateral inner surface of the cylinder.

The magnetic bearing is preferably controlled depending on a measured state variable, in particular if the piston is not to touch the inner surface of the cylinder during operation, wherein the state variable comprises at least one of the following parameters: Displacement path of the piston in the cylinder, Displacement path of the piston rod in the direction of extension of the piston rod, Displacement path of the piston rod perpendicular to the direction of extension of the piston rod, and angle of rotation of the drive shaft. In a further preferred embodiment, the distance of the piston rod relative to the magnetic bearing, at least in the vertical direction, and in particular the gap width in the magnetic bearing between the piston rod and the magnetic bearing is suitable as a state variable.

The sensor for detecting the state variable is preferably designed to detect at least one of the following variables: angle of inclination β of the longitudinal direction relative to the vertical, angle of inclination β as a function of time, gap width between the inner surface of the cylinder and the side surface of the piston, location of a mutual point of contact between the piston and the cylinder.

The packing seal is preferably used in combination with the piston compressor, wherein the piston rod extends through this packing seal or its sealing rings in order to seal the interior of the cylinder from the outside, wherein the packing seal also has the magnetic bearing in addition to the sealing rings. The packing seal according to the invention is particularly preferred designed as a replacement part, so that the packing seal can be removed from the piston compressor as a whole, i.e. as a unit, and reinstalled or replaced by a new packing seal. Particularly preferred, the packing seal according to the invention has the same or essentially the same external dimensions as previously known packing seals without magnetic bearings, so that the packing seal according to the invention comprising the magnetic bearing can be used for installation in existing piston compressors in order to retrofit them and improve their quality.

In a further, preferred embodiment, the packing seal according to the invention also comprises cooling channels. In a packing seal according to the invention mounted in a piston compressor, these cooling channels are connected to a cooling circuit to cool the magnetic bearing and/or the packing seal.

BRIEF DESCRIPTION OF THE DRAWINGS

The drawings used to explain the embodiments show.

In principle, the same parts are given the same reference signs in the drawings.

EMBODIMENTS FOR CARRYING OUT THE INVENTION

Figure 1:
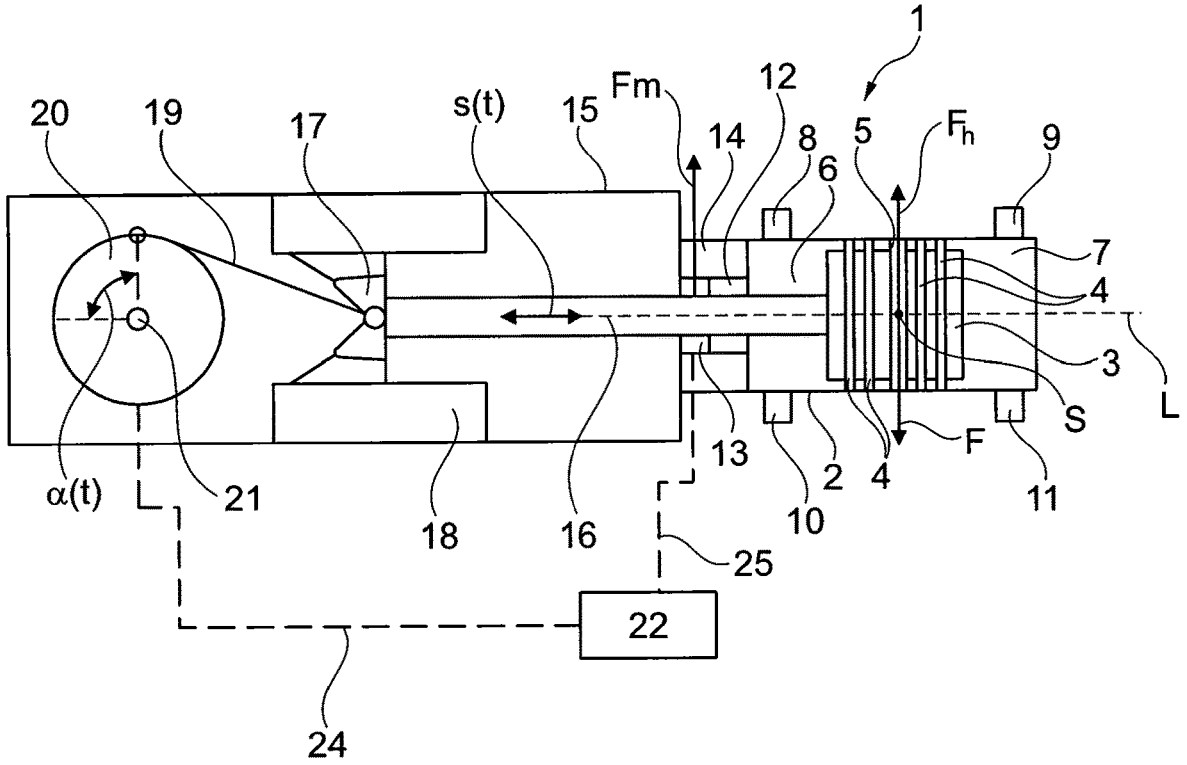
FIG. 1 a schematically simplified longitudinal section through a piston compressor.

FIG. 1 shows a piston compressor 1 for compressing a gas, comprising a cylinder 2 extending in the horizontal direction and comprising a piston 3 movable within the cylinder 2 in the direction of extension of the cylinder 2 respectively in the longitudinal direction L. The piston compressor 1 also comprises a piston rod 16, a packing seal 12, a magnetic bearing 13, a crosshead 17 with a linear guide 18, a push rod 19 and a drive, for example a crank 20 with a drive shaft 21. In the exemplary embodiment shown, the piston 3 is of double-acting design and comprises sealing or piston rings 4 as well as a guide ring 5, the piston 3 dividing the interior of the cylinder 2 into a first interior space 6 and a second interior space 7, these two interior spaces each having an inlet valve 8, 9 and an outlet valve 10, 11. The cylinder 2 is connected to a housing 15 via an intermediate piece 14, with the packing seal 12 and the magnetic bearing 13 also being arranged in the intermediate piece. The magnetic bearing 13 exerts a magnetic force $F_m$ on the piston rod 16 at least in the vertical direction. A control device 22 detects a state variable Z of the piston compressor 1 via a signal line 24 and a sensor not shown, for example the displacement path s(t) of the piston in the cylinder 7 as a function of time, the displacement path s(t) of the piston rod 16 and/or an angle of rotation $\alpha(t)$ of the drive shaft 21 as a function of time. The control device 22 controls, via a signal line 25, the current in the electromagnets of the magnetic bearing 13 and thereby the magnetic force exerted by the magnets on the piston rod 16.

Figure 3:
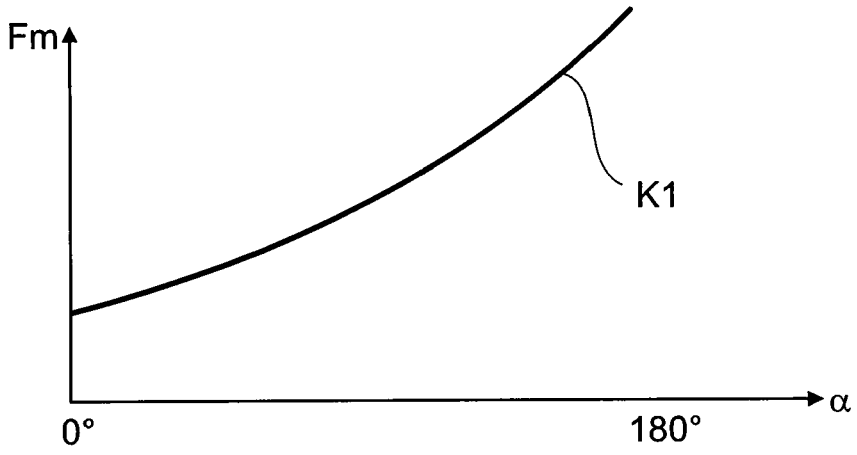
FIG. 3 an exemplary progression of the magnetic force as a function of a state variable, namely the angle of rotation of a drive shaft.

In a simple embodiment, the drive device 22 can be operated in a drive mode in which a state variable Z is measured, and the magnetic force $F_m$ is modified as a function of the state variable Z. In this case, feedback can be dispensed with. FIG. 3 shows an example of such a control mode in which the progression of a curve K1 is specified, the curve K1 specifying the relationship between the state variable Z, in the present case the angle of rotation $\alpha$ of the drive shaft 21, and the magnetic force $F_m$ to be generated as a function of the angle of rotation $\alpha$. In the illustrated exemplary embodiment, the angle $\alpha=0°$ corresponds to the bottom dead center and $\alpha=180°$ to the top dead center of the piston 3 with respect to the second interior space 7, the magnetic force $F_m$ being smallest at the bottom dead center, because the lever arm formed by the piston rod 16 between the center of gravity S of the piston 3 and the magnetic bearing 13 is shortest, and wherein the magnetic force $F_m$ is largest at the top dead center because the lever arm formed by the piston rod 16 between the center of gravity S of the piston 3 and the magnetic bearing 13 is longest. The angle of rotation $\alpha$ is measured by a sensor not shown and fed to the control device 22 via the signal line 24. The curve progression K1 can be predetermined, for example, on the basis of empirical values. This embodiment is particularly preferred if, as shown in FIG. 1, a piston 3 having a guide ring 5 is used, wherein the guide ring 5 bears against the inner surface of the cylinder 2, and wherein the magnetic force $F_m$ serves to reduce the bearing force of the guide ring 5 against the inner surface of the cylinder 2, thereby in particular reducing wear of the guide ring 5. The curve K1 shown in FIG. 3 only shows the progression of the magnetic force $F_m$ as a function of the crankshaft angle $\alpha$ between 0° and 180°. In the subsequent section between 180° and 360°, which is not shown, the force $F_m$, starting from the value at 180°, runs in the reverse direction to the value of $F_m$ at the angle of 0°, this value being identical to the value at the angle of 360°.

Figure 2:
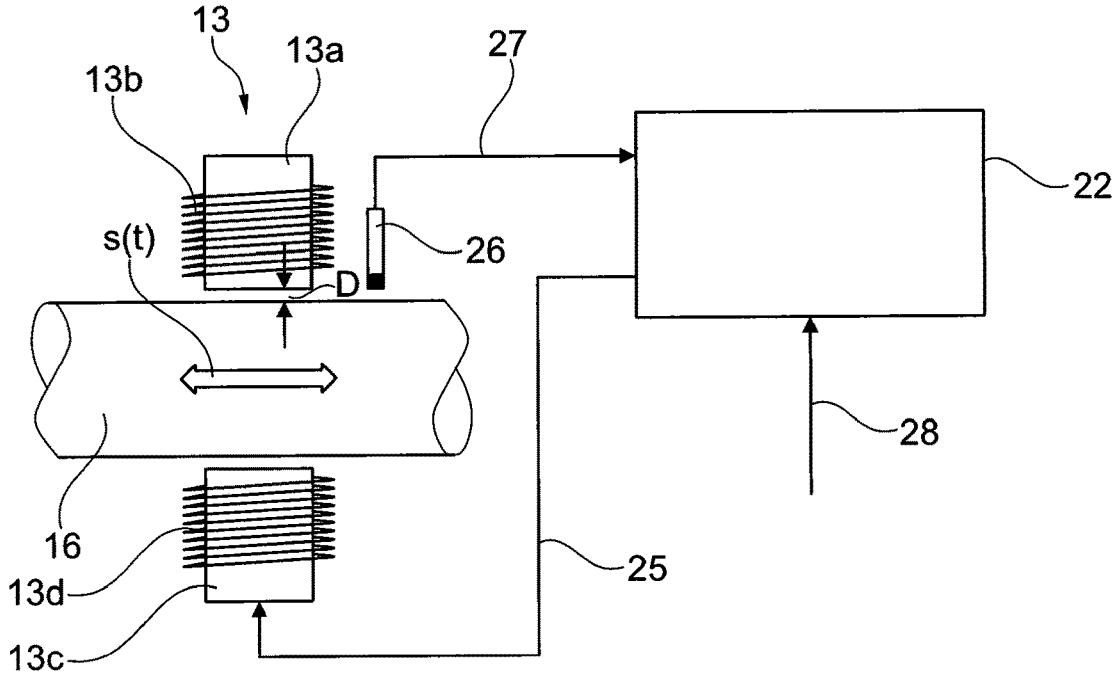
FIG. 2 a schematic illustration of a control device.
Figure 6:
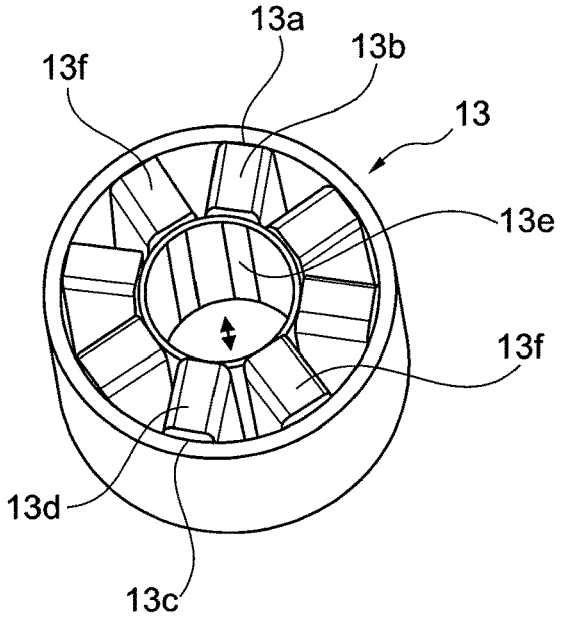
FIG. 6 a radial magnetic bearing.

In a further preferred embodiment, a measuring device, for example a sensor 26, is provided to measure the position of the piston rod 16 and/or the piston 3 at least in the vertical direction. FIG. 2 shows an embodiment which measures the position of the piston rod 16 in the vertical direction. In a preferred embodiment, the sensor 26 is arranged close to the magnetic bearing 13 or even inside the magnetic bearing 13, wherein the sensor 26 preferably measures the distance D between an upper coil core 13*a* of the magnetic bearing 13 and the surface of the piston rod 16. Preferably, the magnetic bearing 13 comprises at least an upper coil core 13*a* with coil 13*b* and a lower coil core 13*c* with coil 13*d*. As shown in FIG. 6, the magnetic bearing 13 can also be designed as a radial magnetic bearing with a plurality of electromagnets 13*f* distributed in the circumferential direction, wherein their coils 13*b*, 13*d* can preferably be controlled individually so that the direction of the magnetic force $F_m$ exerted on the piston rod 16 can be determined by a corresponding control of the coils 13*b*, 13*d*.

In a preferred operating method, a setpoint for the distance D is predetermined for the control device 22 via the setpoint specification 28, with the control device 22 driving the coils 13*b*, 13*d* with current via the signal line 25 in such a way that the piston rod 16 has an essentially unaltered, constant distance D with respect to the upper coil core 13*a*, irrespective of the stroke s(t) or the crankshaft angle $\alpha(t)$. The piston rod 16 thereby acts as a magnetic armature of the two coil cores 13*a*, 13*b*. Preferably, the magnetic bearing 13 can exert both an upward force and a downward magnetic attraction force on the piston rod 16, so that the position of the piston rod 16 relative to the magnetic bearing 13 can be controlled particularly precisely.

The piston compressor 1 is thus preferably operated in such a way that a controllable magnetic force $F_m$ is exerted on the piston rod 16, so that a force $F_m$ acting at least in the vertical direction, or a relief force $F_h$, is exerted on the piston 3 via the piston rod 16, which counteracts the force of gravity F, the magnetic force $F_m$ being controlled or varied as a function of a state variable Z such as, for example, the distance D, the stroke s(t) or the angle of rotation α(t). The arrangement described in FIGS. 1 to 3 and the method described are also suitable for operating or controlling a piston compressor with a cylinder extending in the vertical direction and a piston moving in the vertical direction.

Figure 7:
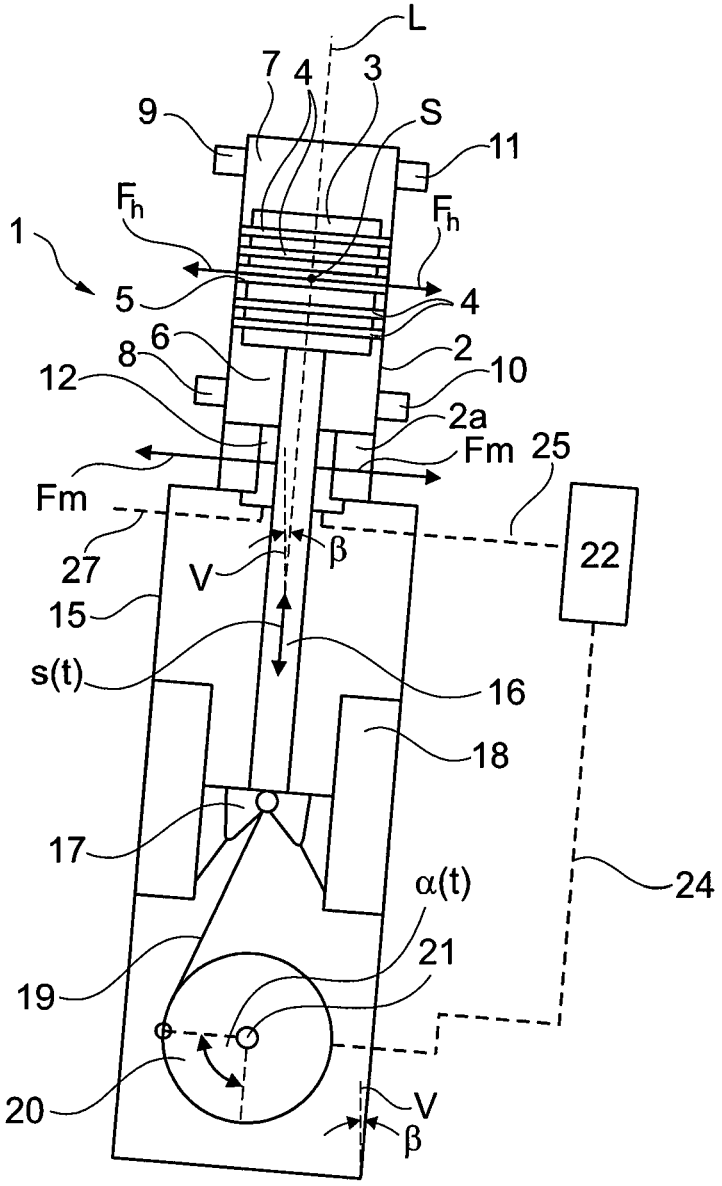
FIG. 7 An inclined piston compressor, for example on a ship with wave motion.

FIG. 7 shows a further example of a piston compressor which, in comparison with the piston compressor 1 shown in FIG. 1, is provided with a cylinder 2 or an interior of a cylinder extending essentially in the vertical direction, with a piston rod 16 extending essentially in the vertical direction, and with a piston 3 movable in this direction. FIG. 7 also shows a packing seal 12 in which the radial bearing 13 is integrated. The radial bearing 13 is supplied with power via line 25 and is connected to a coolant circuit via line 27. In FIG. 7, the piston compressor 1 is arranged on a ship heeled with a heel angle, which is why the cylinder 2 and the piston rod 16 have an angle of inclination β with respect to the vertical V. The piston compressor 1 is preferably arranged in the ship in such a way that the cylinder 2 and the piston rod 16 are exactly in the vertical direction or at least approximately in the vertical direction when the sea is absolutely calm. The piston compressor 1 could of course also be arranged on land, and the cylinder 2 and the piston rod 16 preferably extend exactly in vertical direction or at least approximately in vertical direction. Preferably, the angle of inclination β with respect to the vertical V is measured by a sensor 26 not shown, the angle of inclination β preferably being measured as a function of time t. The magnetic bearing 13 is controlled via the control device 22 in such a way that a magnetic force $F_m$ is exerted on the piston rod 16, and that the piston rod 16 transmits a relief force $F_h$ to the piston 3, so that, due to the acting relief force Fri, the position of the piston 3 within the cylinder 2 is influenced, if possible.

As a state variable Z for controlling the magnetic bearing 13, at least one of the following variables is suitable, in addition to or instead of the state variables Z already mentioned: Angle of inclination β of the cylinder relative to the vertical V, gap width between the inner surface of the cylinder and the side surface of the piston, location of a mutual point of contact between the piston and the cylinder.

Preferably, the magnetic bearing 13 is controlled in such a way that the mutual distance between the piston rod 16 and the magnetic bearing 13 and/or the distance between the cylinder inner surface and the piston side surface, perpendicular to the longitudinal direction L, is kept constant or substantially constant. Preferably, the piston 3 is held without wall contact in the cylinder 7. Preferably, the angle of inclination β(t) assumed between the vertical V and the longitudinal direction L is also measured as a function of time t as the state variable Z. Particularly preferred, in the case of a piston compressor arranged on a ship, the magnetic force $F_m$ is controlled by means of a predictive control. Preferably, the state variable Z comprises the inclination angle β(t) as a function of time t, such that the state variable Z is dependent on time t. In a preferred embodiment, the state variable Z comprises, in addition to the inclination angle β(t) as a function of time t, at least one further state variable mentioned herein, so that such a resulting state variable consists of a combination of at least two state variables mentioned herein. For example, a resulting state variable could comprise the state variable Z of the movement of the piston rod perpendicular to the longitudinal direction L, and be combined with the state variable Z of the inclination angle β(t) as a function of time t, so that with the aid of the predictive control and the knowledge of the state variable Z of the angle of inclination β(t) as a function of the time t, the expected movement of the piston rod perpendicular to the longitudinal direction L caused by the angle of inclination β(t) at the time t+Δt can be predicted, and the magnetic bearing 12 can be controlled with this predictive state variable $Z_V$ (t+Δt).

Preferably, a predictive state variable $Z_V$ (t+Δt) is calculated from the state variable Z(t) depending on the angle of inclination β(t) for a future point in time t+Δt, and the magnetic force $F_m$ is controlled at the current point in time t depending on the predictive state variable $Z_V$ (t+Δt).

Particularly preferred, the piston compressor according to the invention comprising the controllable magnetic bearing is used in combination with a transport ship used for transports over the sea.

Figure 4:
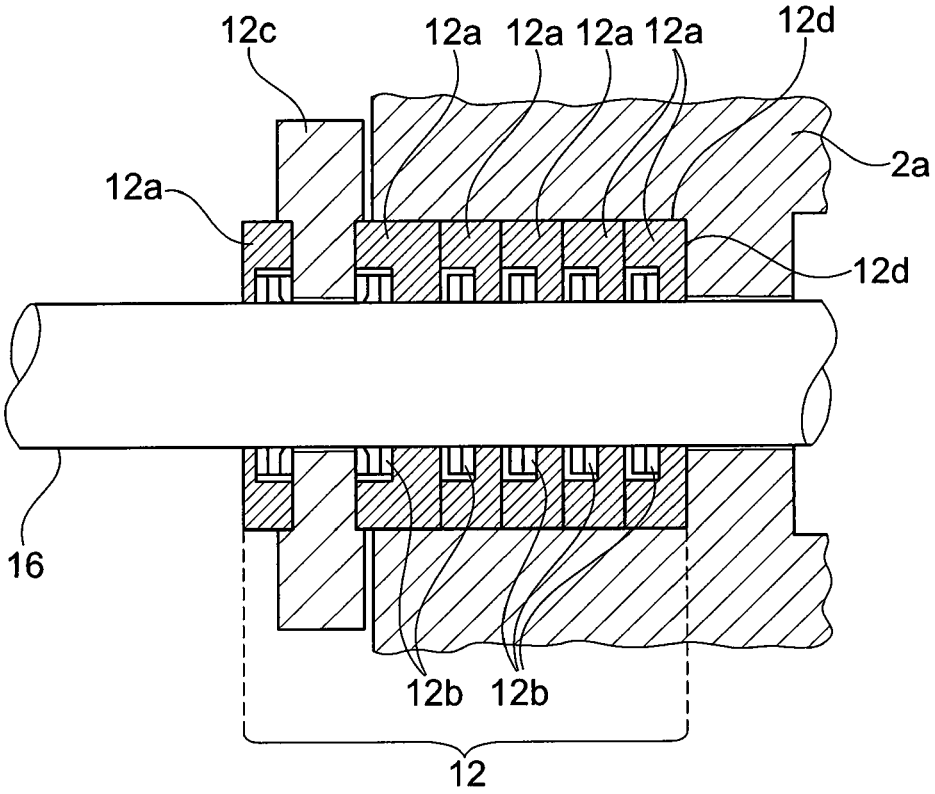
FIG. 4 a longitudinal section through a known packing seal.

The longitudinal section shown in FIG. 4 shows a packing seal 12 known per se, comprising a plurality of chamber rings 12*a* in which sealing rings 12*b* are arranged. In addition, the packing seal 12 comprises a fastening part 12*c* designed as a flange, to which all chamber rings 12*a* are fastened in a manner not shown in detail. The packing seal 12 is connected to a cylinder housing 2*a* of a cylinder 2 via the fastening part 12*c*, wherein a piston rod 16 extends through the packing seal 12. The cylinder housing 2*a* has a recess which corresponds to an outer contour 12*d* of the packing seal 12, so that the entire packing seal 12 can be inserted into this recess and, if necessary, the entire packing seal 12 can be replaced as a complete unit, preferably after the fastening part 12*c* has been detached from the cylinder housing 2*a*.

Figure 5:
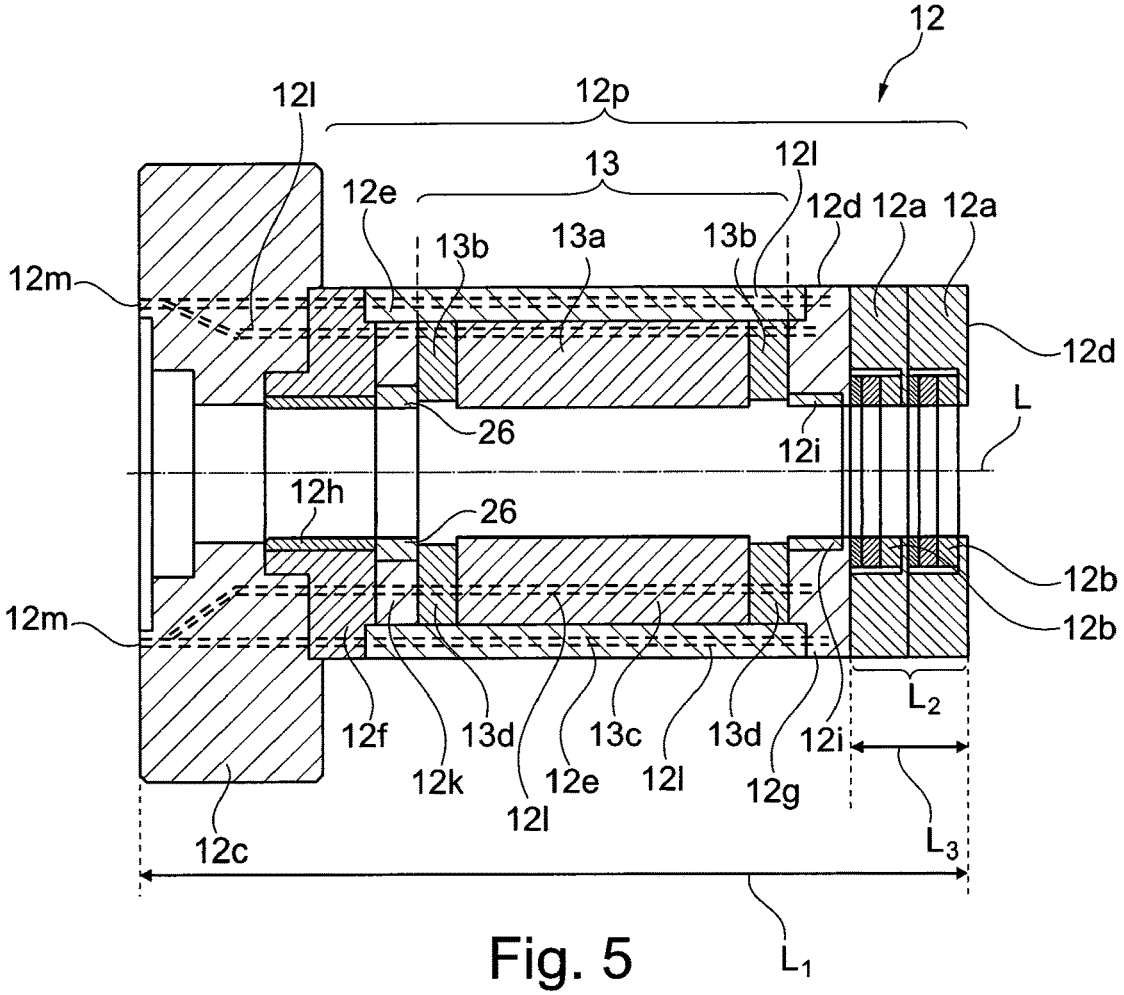
FIG. 5 a longitudinal section through a packing seal according to the invention.

FIG. 5 shows a longitudinal section through a packing seal 12 according to the invention comprising a magnetic bearing 13. FIG. 6 shows a partial section of the magnetic bearing 13, which is designed as a radial bearing and comprises, for example, eight coil cores 13*a*, 13*c*, the two opposing coil cores 13*a*, 13*c* being provided with reference signs. The coil cores 13*a*, 13*c* are wound with coils 13*b*, 13*d*. In addition, the end face 13*e* of the coil core 13*a* facing the piston rod 16 is shown. The packing seal 12 according to FIG. 5 preferably comprises two chamber rings 12*a* in which sealing rings 12*b* are arranged. The packing seal 12 could also have only a single chamber ring 12*a* or more than two chamber rings 12*a* with sealing ring 12*b* arranged therein. The packing seal 12 also includes two emergency bearings 12*f*, 12*g* each having a bearing surface 12*h*, 12*i*. In the event of a power failure of the magnetic bearing 13 or, for example, when the piston compressor is switched off, the piston rod 16 can rest on the emergency bearings 12*f*, 12*g*. Preferably, the packing seal 12 further comprises a holder 12*k* for a sensor 26, wherein preferably at least one sensor 26 is arranged at the top, and wherein preferably a plurality of sensors 26 are arranged mutually spaced in the circumferential direction. In addition, the packing seal 12 comprises a fastening part 12*c*, to which preferably all components shown in FIG. 5 are connected and preferably held firmly together by fastening means not shown, such as screws. The packing seal 12 has an outer contour 12*d*. In a preferred embodiment, the outer contour 12*d* of the packing seal 12 according to the invention is similarly or identically dimensioned to the known packing seal 12 shown in FIG. 4, so that the packing seal 12 according to the invention can be used in existing piston compressors 1 having the known packing seal 12. Preferably, a piston compressor 1 upgraded with the packing seal 12 according to the invention is also provided with a control device 22, so that existing piston compressors 1 can also be provided with the device according to the invention or existing piston compressors 1 can be operated with the process according to the invention.

In a further, preferred embodiment, the packing seal 12 according to the invention, as shown in FIG. 5, also comprises cooling channels 121, which run, for example, inside the outer casing 12*e* and/or inside the coil cores 13*a*, 13*c*, the cooling channels forming part of a cooling circuit in order to cool the magnetic bearing 13 and/or the packing seal 12. The cooling circuit is shown only schematically, the supply lines and the discharge lines of the cooling circuit preferably running through the mounting part 12*c* in such a way that the mounting part 12*c* has connections 12*m* for the cooling circuit which are accessible from the outside, preferably on its end face, and in that the cooling circuit inside the packing seal 12 is predefined and fully configured, so that after installation of the packing seal 12 only the external coolant supply from the outside needs to be connected to the fastening part 12*c* in order to supply the cooling circuit inside the packing seal 12 with coolant. In FIG. 5, in particular, the connecting channels arranged inside the emergency bearing 12*g* and mutually connecting the cooling channels 121 in a fluid-conducting manner are not shown.

Figure 8:
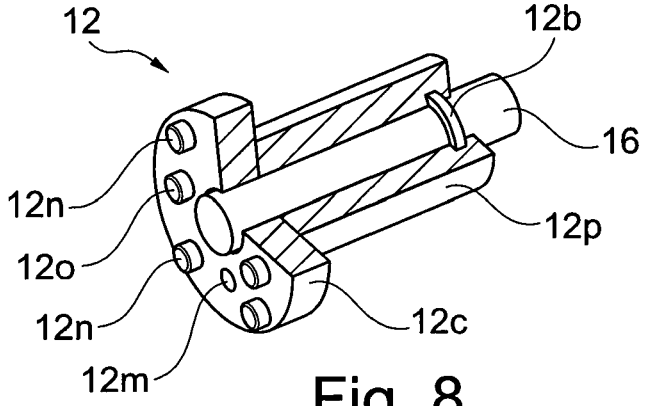
FIG. 8 a simplified illustration of a packing seal with magnetic bearing.

FIG. 8 shows in a simplified representation and partially in section a packing seal 12 with integrated magnetic bearing 13. The packing seal 12 comprises a flange-like fastening part 12*c* and a cylindrical body part 12*p*, which are firmly connected to each other by retaining means 12*o*. The fastening part 12*c* can preferably be fastened to the cylinder housing 2*a* by means of fastening means 12*n*. The packing seal 12 preferably comprises at least one sealing ring 12*b*, and preferably comprises all components shown in FIG. 5, which are not shown in detail in FIG. 8. In the piston compressor 1 shown in FIG. 7, the packing seal 12 is arranged as shown in FIG. 8. The packing seal 12 could be arranged in a variety of different piston compressors 1, for example also in the piston compressor 1 shown in FIG. 1.

The packing seal 12 for a piston compressor 1 shown in FIGS. 5 and 8 comprises a longitudinal axis L, and in succession in the direction of the longitudinal axis L a flange-shaped mounting part 12*c* and a cylindrical part 12*p*, wherein a magnetic bearing 13 and at least one chamber ring 12*a* with a sealing ring 12*b* arranged therein are arranged in succession in the direction of the longitudinal axis L in the cylindrical part 12*p*, wherein the magnetic bearing 13 comprises at least one single controllable electromagnet 13*f*.

Preferably, the magnetic bearing 13 comprises at least two controllable electromagnets 13*f*, which are arranged opposite each other in the cylindrical part 12 with respect to the longitudinal axis L, as shown in FIG. 6.

Preferably, the packing seal comprises at least two emergency bearings 12*f*, 12*g*, which are arranged mutually spaced apart in the direction of the longitudinal axis L.

Preferably, the magnetic bearing 13 is arranged in the direction of the longitudinal axis L between the two emergency bearings 12*f*, 12*g*.

Preferably, the packing seal further comprises a sensor 26 configured to measure the radial position of a piston rod 16 extending through the packing seal with respect to the longitudinal axis L.

Preferably, the sensor 26 is arranged in the direction of the longitudinal axis L between the two emergency bearings 12*f*, 12*g*, wherein the sensor 26 is preferably arranged in the direction of the longitudinal axis L along the magnetic bearing 13.

The packing seal preferably comprises cooling channels 121, which preferably have connections 12*m* arranged on the end face of the flange-shaped mounting part 12*c*. Preferably, the cooling channels 121 run in the direction of the longitudinal axis L along the entire length of the magnetic bearing 13.

Preferably, the chamber rings 12*a* are arranged in the direction of the longitudinal axis L along an end portion L2 of the packing seal 12, the end portion L2 being located at the opposite end of the packing seal with respect to the fastening part 12*c*.

Preferably, the packing seal 12 has an overall length L1 in the direction of the longitudinal axis L, and the end section L2 has an end section length L3, the end section length L3 being less than 50% of the overall length L1, preferably less than 25%, and particularly preferably less than 10%. This embodiment has the advantage that a substantial part of the total length L1 is available for the magnetic bearing 13. A piston rod 16 extending through the packing seal 12 is preferably in contact with the sealing rings 12*b* and thus touches them, whereas the piston rod 16 along the remaining total length L1 preferably does not touch the packing seal 12. This embodiment has the advantage that within the remaining total length L1 a deflection or movement of the piston rod 16 radially to the longitudinal axis L is possible, wherein the maximum possible path of movement is of course limited by the inner cross-section of the passage of the packing seal 12 provided for the piston rod 16. In contrast to the exemplary embodiment according to FIG. 4, the piston rod 16 is thus slightly movable in radial direction with respect to the packing seal 12 within the remaining total length L1, so that the position of the piston rod 16 in radial direction can be corrected particularly well with the aid of the magnetic bearing 13. Particularly preferred, this also allows the position of the piston 3 connected to the piston rod 16 to be corrected with respect to the interior of the cylinder 2, at least in the radial direction. In a preferred embodiment, the sealing rings 12*b* are displaceable radially with respect to the longitudinal direction L in the chamber ring 12*a*. In a further embodiment, the directional rings 12*b* are not displaceable or are only slightly displaceable in this radial direction in the chamber ring 12*a*. This embodiment has the advantage that the chamber ring or rings 12*a* form a kind of pivot point with respect to which the piston rod 16 is slightly rotatable when the piston rod 16 is displaced in the radial direction by the magnetic bearing 13 in the region of the remaining overall length L1, so that the piston 3 connected to the piston rod 16 is preferably displaced in the opposite direction within the cylinder 2. This slight displacement of the piston 3 or at least the application of a force acting in the radial direction to the piston 3 preferably takes place at a relatively high frequency, for example at 10, 100 or 1000 Hz, so that the piston 3 is preferably held continuously and preferably in a central position with respect to the interior of the cylinder 2.

The piston compressor comprises a piston which is moved back and forth in the direction of a longitudinal axis within a cylinder, the piston being driven by a crosshead via a piston rod, and comprising a packing seal with a controllable magnetic bearing and at least one chamber ring 12*a* with a sealing ring 12*b* arranged therein, wherein the piston rod 16 extends through the packing seal 12, and wherein a controllable magnetic force $F_m$ acting at least perpendicularly to the longitudinal axis L is exerted on the piston rod 16 via the controllable magnetic bearing 13.

Preferably, a state variable Z of the piston compressor 1 is detected, wherein the magnetic force $F_m$ is controlled as a function of the state variable Z, and wherein a force $F_h$ is thereby exerted on the piston 3 via the piston rod 16.

Preferably, the state variable Z is measured within the packing seal 12, with the controllable magnetic bearing 13 having a centering effect on the position of the piston 3 within the cylinder 7 via the piston rod 16.

In the embodiment shown in FIG. 1, a piston compressor 1 comprising a piston 3 with piston rings or sealing rings 4 and a guide ring 5 is shown. The guide ring 5 could be dispensed with. In another embodiment, not shown, the piston 3 could also be designed as a labyrinth piston, wherein this labyrinth piston preferably does not touch the inner wall of the cylinder 2.

Embodiments of piston compressors and methods of operation are described below.

Item 1: A piston compressor 1 for compressing a gas, comprising a cylinder 2, a piston 3, a piston rod 16, a packing seal 12, a crosshead 17, a magnetic bearing 13, and a drive 21, wherein the piston 3 is arranged movably in a longitudinal direction L within the cylinder 2, wherein the piston 3 is connected to the crosshead 17 via the piston rod 16, wherein the packing seal 12 is arranged between the piston 3 and the crosshead 17, through which the piston rod 16 extends, wherein the crosshead 17 is driven by the drive 21, the magnetic bearing 13 being arranged between the piston 3 and the cross head 17, and the magnetic bearing 13 being capable of exerting a magnetic force $F_m$ on the piston rod 16 at least perpendicularly to the longitudinal direction L, a sensor 26 being arranged for detecting a state variable Z of the piston compressor 1, the magnetic bearing 13 being designed as a controllable magnetic bearing 13, and a control device 22 controlling the magnetic force $F_m$ exerted by the magnetic bearing 13 on the piston rod 16 as a function of the state variable Z.

Item 2: A piston compressor according to item 1, with the cylinder 2 extending in a substantially horizontal direction.

Item 3: A piston compressor according to item 1, with the cylinder 2 extending in a substantially vertical direction.

Item 4: A piston compressor according to one of items 1 to 3, wherein the sensor 26 is designed to detect at least one of the following variables as a state variable Z: displacement path of the piston in the cylinder, displacement path of the piston rod in the direction of extension of the piston rod, displacement path of the piston rod perpendicular to the running direction of the piston rod, movement of the piston perpendicular to the running direction of the piston rod, angle of rotation of the drive shaft, gap width within the magnetic bearing 13 between the piston rod 16 and a magnet of the magnetic bearing 13.

Item 5: A piston compressor according to any one of items 1 to 4, wherein the sensor 26 is configured to detect at least one of the following parameters: Angle of inclination β of the longitudinal direction L with respect to the vertical V, gap width between the inner surface of the cylinder and the side surface of the piston, location of a mutual contact point of the piston and the cylinder.

Item 6: A piston compressor according to any one of items 1 to 5, wherein the packing seal 12 is configured as a replacement part, and wherein the packing seal 12 comprises both at least one seal ring 23 and the magnetic bearing 13.

Item 7: A piston compressor according to any one of items 1 to 6, wherein the piston 3 is designed as a labyrinth piston.

Item 8: A piston compressor according to any one of items 1 to 6, wherein the piston 3 comprises a plurality of seal rings 4 and preferably also a guide ring 5.

Item 9: A piston compressor according to any one of items 1 to 8, wherein the packing seal 12 and the magnetic bearing 13 comprise cooling channels 121 for a coolant.

Item 10: A piston compressor according to any one of items 1 to 9, wherein the packing seal 12 comprises, arranged sequentially in the longitudinal direction L, at least one fastening part 12*c*, the magnetic bearing 13, and at least one chamber ring 12*a* with a seal ring 12*b* arranged therein.

Item 11: A piston compressor according to item 10, wherein the packing seal 12 comprises at least two emergency bearings 12*f*, 12*g* which are mutually spaced in the longitudinal direction L.

Item 12: A method for operating a piston compressor 1 comprising a piston 3, which is moved back and forth in a longitudinal direction L within a cylinder 7, wherein the piston 3 is driven via a piston rod 16, and wherein a magnetic force $F_m$ acting at least perpendicular to the longitudinal direction L is exerted on the piston rod 16, wherein a state variable Z of the piston compressor 1 is detected, wherein the magnetic force $F_m$ is controlled as a function of the state variable Z, and wherein a force $F_h$ is thereby exerted on the piston 3 via the piston rod 16.

Item 13: A method according to item 12, wherein the longitudinal direction L is substantially in the horizontal direction.

Item 14: A method according to item 12, wherein the longitudinal direction L is substantially in the vertical direction.

Item 15: A method according to item 12, wherein the longitudinal direction L has an angle of inclination β in the range of +/−10° with respect to the vertical V.

Item 16: A method according to any one of items to 15, wherein the state variable Z comprises at least one of the following variables, displacement path of the piston 3 in the cylinder 7, displacement path of the piston rod 16 in the longitudinal direction L, movement of the piston rod 16 perpendicular to the longitudinal direction L, movement of the piston 3 perpendicular to the longitudinal direction L, angle of rotation of a drive shaft 21 driving the piston rod 16; gap width within the magnetic bearing 13 between the piston rod 16 and a magnet of the magnetic bearing 13.

Item 17: A method according to any one of items 12 to 15, wherein the mutual position of the piston rod 16 and the magnetic bearing 13, perpendicular to the longitudinal direction L of the piston rod 16, is measured as the state variable Z.

Item 18: A method according to any one of items 12 to 15, wherein as a state variable Z at least one of the following variables: Inclination angle β of the cylinder with respect to the vertical V, gap width between the inner surface of the cylinder and the side surface of the piston, location of a mutual contact point of the piston and the cylinder.

Item 19: A method according to any one of items 12 to 18, wherein the mutual distance of piston rod 16 and magnetic bearing 13 and/or the distance of the inner surface of the cylinder and the piston side surface, perpendicular to the longitudinal direction L, is kept constant.

Item 20: A method according to any one of items 12 to 19, wherein the piston 3 is held in the cylinder 7 without wall contact.

Item 21: A method according to any one of items 12 to 20, wherein, moreover, as a state variable Z, the angle of inclination β(t) assumed between the vertical V and the longitudinal direction L is measured as a function of time t.

Item 22: A method according to any one of items 12 to 21, wherein the magnetic force $F_m$ is controlled by means of a predictive control system.

Item 23: A method according to item 22, where the state variable Z comprises the inclination angle β(t) as a function of time t, such that the state variable Z is dependent on time t.

Item 24: A method according to item 23, wherein a predictive state variable $Z_V(t+\Delta t)$ is calculated from the state variable Z(t) as a function of the inclination angle β(t) for a future point in time t+Δt, and in that the magnetic force $F_m$ is controlled at the current point in time t as a function of the predictive state variable $Z_V(t+\Delta t)$.

Item 25: A method according to any one of items 12 to 20, wherein the magnetic force $F_m$ is fixedly predetermined as a function of the state variable Z.

The invention claimed is:

1. A packing seal for a piston compressor, comprising a longitudinal axis L and, following one after another in the direction of the longitudinal axis L, a fastening part and a cylindrical part, wherein in the cylindrical part a magnetic bearing with an upper coil core and a lower coil core and a seal are arranged, wherein the magnetic bearing comprises a controllable electromagnet, wherein the seal is designed as a chamber ring with a sealing ring arranged therein, the sealing ring being radially displaceable with respect to the longitudinal axis L in the chamber ring, and wherein in the cylindrical part, after the fastening part, following one after the other in the direction of the longitudinal axis L, the magnetic bearing and the chamber ring are arranged, wherein said fastening part is flange-shaped, and said packing seal further comprising cooling channels, said cooling channels having ports arranged on a front side of the flange-shaped fastening part, and wherein the cooling channels extend in the direction of the longitudinal axis L along the entire length of the magnetic bearing.

2. The packing seal according to claim 1, wherein the magnetic bearing comprises at least two controllable electromagnets which are arranged opposite each other with respect to the longitudinal axis L in the cylindrical part.

3. The packing seal according to claim 1, comprising two emergency bearings which are mutually spaced in the direction of the longitudinal axis L.

4. The packing seal according to claim 3, wherein the magnetic bearing is arranged in the direction of the longitudinal axis L between the two emergency bearings.

5. The packing seal according to claim 3, further comprising a sensor designed to measure a radial position of a piston rod passing through the packing seal with respect to the longitudinal axis L.

6. The packing seal according to claim 5, wherein the sensor is arranged in the direction of the longitudinal axis L between the two emergency bearings.

7. The packing seal according to claim 6, wherein the sensor is arranged in the direction of the longitudinal axis L along the magnetic bearing.

8. The packing seal according to claim 1, wherein the chamber ring is arranged in the direction of the longitudinal axis L along an end portion $L_2$, said end portion $L_2$ being located at an opposite end of the packing seal with respect to the fastening part.

9. The packing seal according to claim 8, having an overall length $L_1$ in the direction of the longitudinal axis L, the end section $L_2$ having an end section length $L_3$, the end section length $L_3$ being less than 50% of the overall length $L_1$.

10. The packing seal according to claim 1, wherein a plurality of chamber rings are arranged in the direction of the longitudinal axis L along an end portion $L_2$ of the packing seal, the end portion $L_2$ being located at an opposite end of the packing seal with respect to the fastening part.

11. The packing seal according to claim 1, wherein the packing seal comprises cooling channels extending inside an outer casing of the packing seal and/or inside a coil core of the magnetic bearing.

12. A piston compressor comprising a packing seal according to claim 1.

13. A method for operating a piston compressor comprising the steps:

moving a piston back and forth in the direction of a longitudinal axis L within a cylinder, the piston being driven via a piston rod, and comprising a packing seal according to claim 1 with a controllable magnetic bearing and a seal, wherein the piston rod extends through the packing seal, and exerting a controllable magnetic force $F_m$ acting at least perpendicular to the longitudinal axis L on the piston rod via the controllable magnetic bearing, wherein the piston rod is sealed in the seal by a chamber ring with a sealing ring arranged therein, and the piston rod is sealed between the piston and the magnetic bearing, and moving the piston rod radially with respect to the longitudinal axis L by the magnetic bearing, thereby reducing a contact force of the piston supported on an inner surface of the cylinder, the piston rod bearing against the sealing ring, and the sealing ring being radially displaced with respect to the longitudinal axis L with respect to the chamber ring.

14. The method according to claim 13, wherein a state variable (Z) of the piston compressor is detected, the magnetic force $F_m$ is controlled as a function of the state variable (Z), and a force $F_h$ is thereby exerted on the piston via the piston rod.

15. The method according to claim 14, wherein the state variable (Z) is measured within the packing seal, and the controllable magnetic bearing acts in a centering manner via the piston rod on the position of the piston within the cylinder.

* * * * *